US008052017B2

(12) United States Patent
Ivison

(10) Patent No.: US 8,052,017 B2
(45) Date of Patent: Nov. 8, 2011

(54) PIN MOOR

(76) Inventor: Loretta Ivison, Santa Cruz, CA (US)

( * ) Notice: Subject to any disclaimer, the term of this patent is extended or adjusted under 35 U.S.C. 154(b) by 598 days.

(21) Appl. No.: 11/991,757

(22) PCT Filed: Sep. 26, 2006

(86) PCT No.: PCT/US2006/037423

§ 371 (c)(1),
(2), (4) Date: Mar. 10, 2008

(87) PCT Pub. No.: WO2007/061502

PCT Pub. Date: May 31, 2007

(65) Prior Publication Data

US 2009/0266852 A1 Oct. 29, 2009

(51) Int. Cl.
*A41H 17/00* (2006.01)

(52) U.S. Cl. ..... 223/109 R; 223/100; 223/102; 112/260; 112/117

(58) Field of Classification Search ..... 24/705, 24/595.1, 900.1, 578.1, 253, 356, 1, 13, 6; 223/100, 109 R, 102; 2/1, 69
See application file for complete search history.

(56) References Cited

U.S. PATENT DOCUMENTS

| | | | | | |
|---|---|---|---|---|---|
| 38,817 | A | * | 6/1863 | Earle | 223/109 R |
| 229,080 | A | * | 6/1880 | Ballou | 24/705 |
| 245,653 | A | * | 8/1881 | Naramore | 206/383 |
| 302,670 | A | * | 7/1884 | Poter | 223/100 |
| 526,746 | A | * | 10/1894 | Ruffner | 24/706.9 |
| 752,536 | A | * | 2/1904 | Dunconbe | 223/109 R |
| 2,016,601 | A | * | 10/1935 | Hlavaty | 428/102 |
| 2,040,289 | A | * | 5/1936 | Adams | 66/117 |
| 2,056,685 | A | * | 10/1936 | Miller | 24/355 |
| 2,712,261 | A | * | 7/1955 | Anderson | 411/487 |
| 2,873,901 | A | * | 2/1959 | Liniger | 223/109 R |
| 3,088,295 | A | * | 5/1963 | Haines | 63/20 |
| 3,500,829 | A | * | 3/1970 | Abramowitz | 604/170.01 |
| 4,134,183 | A | * | 1/1979 | Fischer | 24/132 AA |
| 4,404,713 | A | * | 9/1983 | Dorsey | 24/662 |
| 4,507,344 | A | * | 3/1985 | Baughman | 428/99 |
| D279,835 | S | * | 7/1985 | Gakiya | D3/28 |
| 4,608,939 | A | * | 9/1986 | Lampley | 112/260 |
| 4,774,817 | A | | 10/1988 | Beam et al. | 63/12 |
| 4,943,274 | A | * | 7/1990 | Edwards | 604/2 |
| 4,961,275 | A | * | 10/1990 | Klein | 40/1.5 |
| 5,170,542 | A | * | 12/1992 | Greenberg | 24/705 |
| D431,010 | S | | 9/2000 | Guthier | D11/88 |
| 6,279,202 | B1 | * | 8/2001 | Wojdylak et al. | 24/12 |
| 2008/0289550 | A1 | * | 11/2008 | Preston | 112/117 |

* cited by examiner

*Primary Examiner* — Katherine Moran
*Assistant Examiner* — Richale Quinn
(74) *Attorney, Agent, or Firm* — Jeffrey A. Hall

(57) ABSTRACT

A moor or anchor (10) for pins (12), needles, or other sewing implements, comprising a moor or anchor having a first end and a second end, the first (14) and the second end (16) are connected by a central portion (30) which may be curved (18), whereby the moor or anchor (10) can be positioned on a surface (20) and receive a pin (12), needle, or other sewing implement to anchor apiece of fabric (19) to the surface. The surface (20) may be fabric, cloth, vinyl, plastic, or any other flexible material. The moor or anchor (10) may be configured in various shapes and include curved portions (18) and planar surfaces (26). A method for using the moor to secure and position pins and other sewing implements to surfaces such as fabric or other flexible material is also disclosed.

9 Claims, 1 Drawing Sheet

PIN MOOR

TECHNICAL FIELD

This invention relates to devices for holding and positioning pins or other sewing implements, and more particularly to a pin moor or anchor for securing pins and other sewing implements in a desired position, and for positioning pieces of fabric.

BACKGROUND ART

Various devices have been proposed and implemented for holding and positioning articles. Although prior devices have been adapted and used for various purposes, there exists a need for a pin moor or anchor for positioning and securing pins or other sewing implements in a desired location on a quilt or other piece of fabric.

When making a quilt, quilters begin a quilt project they generally have three layers of material. The top of the quilt which is usually the work area of the project, into which they have often invested large amounts of time to develop. The batting is positioned in the middle, and then there is a backing layer for the quilt. Holding these three layers of the quilt together has been an effort for quilters for hundreds of years.

In the past, there have been methods and devices proposed and implemented for this task. For example, basting with a needle and thread has been done for many years and is still used by some quilters, although it is very labor intensive and takes hours of time and effort to implement.

Another method of holding layers of cloth together in quilting and other sewing operations is the use of a safety pin. The primary difficulties with safety pins is that the safety pins are hard to close and often get in the way of the machine being used or the hand needle when the quilting is being done. There have also been proposed and implemented devices and methods to help open and close the safety pin in sewing and quilting operations.

Another example of devices to help position and hold fabric in quilting operations is a plastic gun device which is used to shoot plastic tabs through the three layers of fabric. Such device is difficult to use, is inconsistent in operation, and leaves large holes in the fabric. Further, the plastic tabs shot by such device are difficult to remove from the cloth.

The present invention provides a means and a method for holding pins and other sewing implements in position when quilting or during other sewing operations. Although pins are very useful, easy to move around, and do not put large holes in the fabric, and are an effective way to hold pieces of cloth together, when used alone, there is nothing to hold them in place. In fact, this is a significant limitation of using pins or other sewing implements alone. The pin moor or anchor of the present invention provides a means to anchor and securely position the pin in a desired position. With the pin moor or anchor attached to the sharp end of the pin, the pin only moves when someone moves it.

The present invention may also be used in the Applique part of the quilt making process where layers of fabric are piled onto one another and then sewed together. Typically, there are a variety of glues and safety pins used to hold the materials together. In this process the pin moor of the present invention is very useful and efficient, as the pins are anchored to a pin moor, and no longer move or shift position until the quilter wants them to. The layers of fabric are placed where the user wants and a pin is inserted into the layers of fabric and the pin moor. This secures the pin and fabric in place until it is moved or removed by the user while sewing the fabric layers together, either by hand or machine.

Accordingly, the primary object of the present invention is to provide a pin moor or anchor, which secures a pin and any attached cloth or fabric in desired location. The pin moor or anchor may be easily positioned and secured where desired, and is very easy to use and efficient in operation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DISCLOSURE OF INVENTION

To achieve the foregoing objects, and in accordance with the purpose of the invention as embodied and broadly described herein, a portable, stable, moor for pins, needles, or other sewing implements is provided comprising a moor having a first end and a second end, the first and the second end are connected by a central portion which may be curved, whereby the moor can be positioned on a surface and receive a pin, needle, or other sewing implement to anchor a piece of cloth to the surface of another piece of cloth. The moor may be configured in various shapes and include curved portions and planar surfaces. A method for using the moor to secure and position pins and other sewing implements to pieces of cloth is also disclosed.

BRIEF DESCRIPTION OF DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

BEST MODE FOR CARRYING OUT THE INVENTION

Reference will now be made in detail to the present preferred embodiments of the invention as illustrated in the accompanying drawings.

In accordance with the present invention, there is provided in a preferred embodiment of the invention, a portable, stable, moor or anchor for pins, needles, or other sewing implements, comprising, a moor having a first end and a second end, the first and the second end are connected by a central portion which may be curved, whereby the moor can be positioned on a surface and receive a pin, needle, or other sewing implement to anchor a piece of fabric to the surface. The surface may be any fabric, cloth. vinyl, plastic, or the like.

Figure 1:
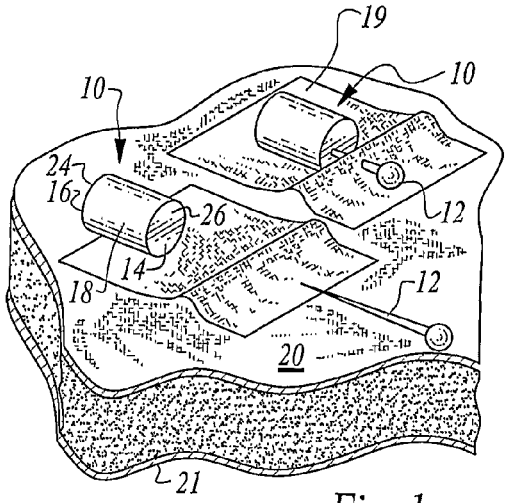
FIG. 1 shows a pin moor securing a pin and a piece of fabric to a quilt, according to the invention.

In FIG. 1, a preferred embodiment of pin moor or anchor 10, is shown. Preferably, moor 10, is utilized for receiving and securing pins 12, or other sewing implements such as needles therein. Moor 10 may be described herein as a moor or an anchor interchangeably. In a preferred embodiment, moor 10, has a first end 14, and a second end 16. The first and second end are connected by a curved portion 18, whereby moor 10, can be positioned on a surface, such as the surface of a quilt 20, or other surface, and receive a pin 12, needle, or other sewing implement to anchor a piece of fabric 19, to surface 20. Surface 20, is shown as a quilt surface or batting, and may have backing 21, however, moor 10, may be used on any surface, such as fabric, cloth, vinyl, plastic or the like. Pin moor or anchor 10, is composed of a durable, resilient, pin penetrable material such as rubber, plastic, foam, paper, neoprene, or the like.

Preferably, moor 10, for pins 12, needles, and other sewing implements has first end 14, which may be circular in configuration 22. However, as described below, other configurations may be used if desired. Moor 10, may be provided in any size desired, however, a preferred size is approximately ½ inch in length and ¼ inch in diameter for the embodiment shown in FIGS. 1 and 2.

Figure 2:
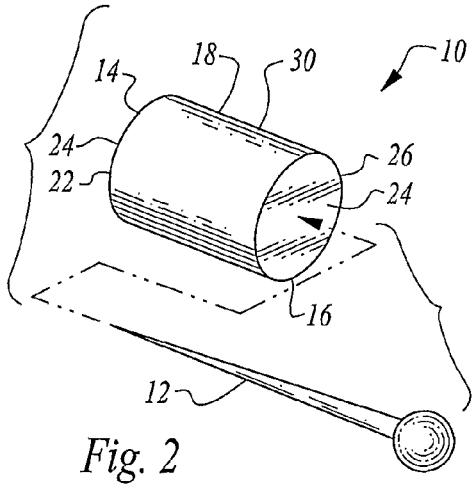
FIG. 2 shows a pin secured to a pin moor, according to the invention.

In a preferred embodiment, best seen in FIGS. 1 and 2, second end 16, is also circular 24, in configuration. As with first end 14, other configurations besides circular, such as rectangular, square, oval, or other geometric configurations may be used for second end 16, as well. Moor 10, may included one or more planar surfaces 26, such as first and second end, 14, and 16, which are shown as circular in configuration and planar as well.

Pin moor 10, provides an anchor mechanism for holding two or more layers of fabric together. Pin moor 10, with first end 14, and second end 16, has a connecting central portion 30, allows the anchor or moor 10, be positioned on a surface and receive a pin 12, to anchor a piece of fabric 19, to surface 20. Central portion 30, may be curved 24, as described above or otherwise. In the embodiments shown in FIGS. 3, 4, and 5, connecting central portion 30, is not curved.

Figure 3:
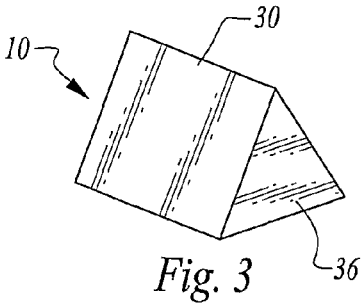
FIG. 3, shows a pin moor with a triangular face according to another embodiment of the invention.

In FIG. 3, an embodiment of pin moor or anchor 10, is shown in a shape having at least one face configured as a triangle, which may be a planar triangular surface 36, seen in FIG. 3.

Figure 4:
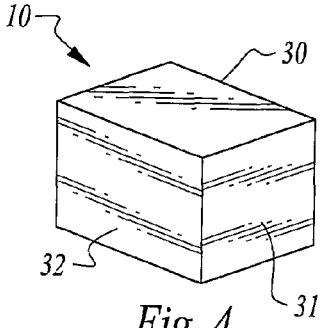
FIG. 4 shows a pin moor configured as a cube, according to another embodiment of the invention.

In FIG. 4, an embodiment of pin moor or anchor 10, is shown configured as a cube 32, with square sides 31.

Figure 5:
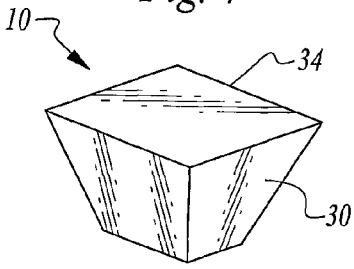
FIG. 5 shows a pin moor with a planar surface, according to the invention.
Figure 6:
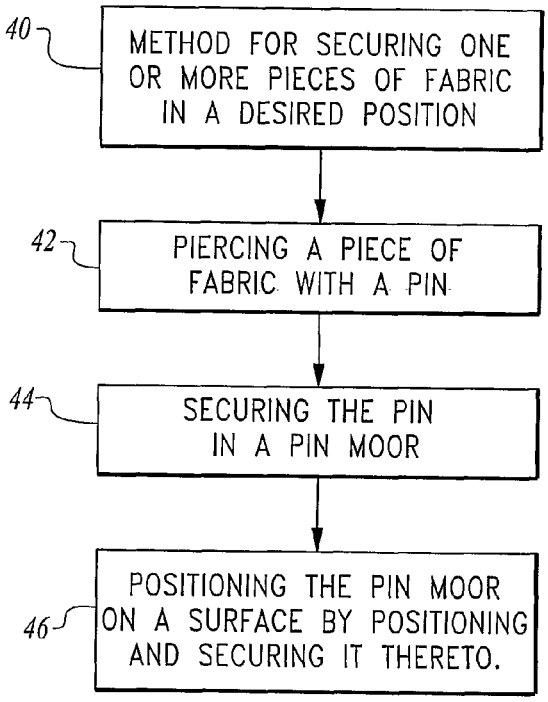
FIG. 6, is a flow chart of a methodology of holding a piece of fabric using a pin moor, according to the invention.

With reference now to FIG. 5, pin moor or anchor 10, is shown with one or more planar surfaces configured as a rectangle 34.

Figure 7:
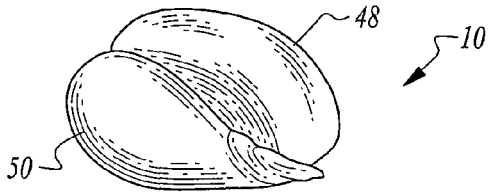
FIG. 7 shows a pin moor in an irregular configuration, here in a shell-shape, according to the invention.

In other embodiments, pin moor or anchor 10, may be configured for example, as a shell 48, with irregular edges 50, as seen in FIG. 7, or any other shape such as a leaf, fruit, vegetable, animal or any other irregular or abstract configuration.

Using the pin moor or anchor 10, described in detail above, a method 40, for securing and positioning one or more pieces of fabric in a desired position is disclosed, preferably comprising the steps of: piercing a piece of fabric with a pin, step 42; securing the pin in a pin moor, step 44; and, positioning the pin moor on the surface of a second piece of fabric by positioning and securing the pin moor to the second piece of fabric, step 46.

In operation and use, pin moor or anchor 10, is very easy to use, efficient, and reliable, for holding pieces of fabric together and positioning and securing a pin or other sewing implement in a desired location. Pin moor or anchor 10, may be used in quilting and other sewing operations and is inexpensive to manufacture and easy to use. Pin moor or anchor 10, may be provided in a wide variety of different sizes and configurations, and is preferably composed of a durable, resilient, pin penetrable material such as rubber, plastic, foam, or the like.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

The invention claimed is:

1. A method for quilt making and sewing for securing and positioning two or more pieces of fabric in a desired position in relationship to one another, the method comprising the steps of:

positioning a first piece of fabric and a second piece of fabric in a desired location in relationship to one another;

piercing sequentially said first piece of fabric and said second piece of fabric with a pin or other sewing implement, so that the pieces of fabric are oriented in a desired relationship to one another, to allow precise quilt making and sewing; and securing said pin or other sewing implement in a surface of a pin moor, the pin moor comprising a penetrable material having a first end and a second end; and a central portion connecting said first end and said second end, whereby said moor can be interchangeably positioned on a surface and receive a pin, or other sewing implement, anywhere in the moor, and further wherein the moor is solid, and has a solid core, such that each surface of the moor is substantially continuous, and by partially inserting said pin or other sewing implement into said pin moor, the pin moor is positioned directly on the surface of said first or second piece of fabric, thereby securely positioning said first and second piece of fabric, by anchoring the first piece of fabric to the surface of the second piece of fabric.

2. The method of claim 1, wherein said pin moor has a central portion which is curved.

3. The method of claim 1, wherein said pin moor has one or more planar surfaces.

4. The method of claim 1, wherein said pin moor has one or more surfaces shaped as a rectangle.

5. The method of claim 1, wherein said pin moor has one or more surfaces triangular in shape.

6. The method of claim 1, wherein said pin moor has one or more planar surfaces circular in shape.

7. The method of claim 1, wherein said pin moor is configured as a shell.

8. The method of claim 1, wherein said pin moor is square in configuration.

9. The method of claim 1, wherein said pin moor is configured as a cube.

* * * * *